United States Patent [19]

Wendt

[11] 4,263,764

[45] Apr. 28, 1981

[54] ACESSIBLE PARTITION WALL CONSTRUCTION

[75] Inventor: Alan C. Wendt, Barrington, Ill.

[73] Assignee: United States Gypsum Company, Chicago, Ill.

[21] Appl. No.: 71,819

[22] Filed: Sep. 4, 1979

[51] Int. Cl.[3] ..... E04B 2/60

[52] U.S. Cl. ..... 52/481; 52/486; 52/489; 52/713

[58] Field of Search ..... 52/481, 486, 489, 713

[56] References Cited

U.S. PATENT DOCUMENTS

| | | | |
|---|---|---|---|
| 1,998,688 | 4/1935 | Robinson et al. . | |
| 2,089,046 | 8/1937 | Venzie | 52/489 |
| 2,271,584 | 2/1942 | Fellom . | |
| 2,568,490 | 9/1951 | Dunham et al. | 52/489 |
| 2,994,413 | 8/1961 | Levy et al. | 52/481 X |
| 3,256,666 | 6/1966 | Farmer | 52/481 |
| 3,412,515 | 10/1968 | Finon | 52/480 X |
| 3,465,487 | 9/1969 | Fatosme | 52/481 X |
| 3,533,205 | 10/1970 | Pestel | 52/481 X |
| 3,683,575 | 8/1972 | Meziere | 52/480 X |
| 3,731,447 | 5/1973 | Dawdy | 52/481 X |
| 3,732,660 | 5/1973 | Byssing | 52/489 |
| 3,753,325 | 8/1973 | Stanley et al. | 52/489 |
| 3,759,001 | 9/1973 | Judkins et al. | 52/481 X |
| 3,842,554 | 10/1974 | Swick | 52/489 X |
| 3,862,530 | 1/1975 | Martine | 52/481 X |
| 3,900,996 | 8/1975 | Yohe | 52/489 X |
| 3,922,764 | 12/1975 | Downing, Jr. | 52/489 X |
| 3,998,018 | 12/1976 | Hodges | 52/481 |

*Primary Examiner*—Alfred C. Perham

*Attorney, Agent, or Firm*—Samuel Kurlandsky; Robert H. Robinson; Glenn W. Ohlson

[57] ABSTRACT

An accessible partition wall construction comprising in combination: Two parallel spaced-apart rows of wall panels; channel-shaped studs disposed at panel joints; stud clips engaging the studs at a flange and rib; interchangeable panel clips removably engaging the stud clips; whereby the partition wall construction allows accessibility by lifting a panel upward to slide an overlapped panel clip off a stud clip and then moving the panel horizontally away from the construction, and wherein reinstallation is accommodated by reversing the procedure, whereby said panel clips are interchangeable at either side of the joint and wherein extending projections of said panel clips are substantially identical and the panel clip is symmetric about a horizontal plane.

17 Claims, 4 Drawing Figures

ACESSIBLE PARTITION WALL CONSTRUCTION

BACKGROUND OF THE INVENTION (1) Field of the Invention

The invention relates to an accessible partition wall construction wherein wall panels are engaged by substantially identical and interchangeable panel clips which facilitate removable engagement with a stud clip resiliently engaging a channel-shaped stud having an engageable flange and engageable longitudinal rib at the junctures of the flanges and web of the channel-shape.

(2) Description of the Prior Art

Hollow-wall partition construction is a widely used method of construction for use in residential, commercial, and industrial applications. Generally, two parallel spaced-apart rows of wall panels, typically comprising gypsum wallboard panels, are aligned in edge-to-edge relationship having joints therebetween with vertical studs located at said joints for necessary support. Conventional construction techniques involve permanent affixation of wallboard to studs by means of nailing or screwing through the panels into the surfaces of a stud. With the advent of relocatable partition systems this relatively fixed, or permanent, installation has become less frequently used.

In attempts to provide demountable and accessible systems, many hollow-wall partition constructions utilize various studs, clips, shims, panel edge configurations, and other components to facilitate removing panels without damaging elements of the wall system. Such removability has been attained by using rabbet edged panels, kerfed edged panels, and simple tapered and square-edged panels. In providing removability, many systems require specially formed studs for adaptability with panel engaging clips. Such studs typically require particular slots or marginal elements adaptable for use with particularly shaped clips. Other systems utilize conventional I-shaped or channel-shaped studs and attain accessibility by resiliently engageable clips. While accessibility is thereby obtained, uniformity of joints becomes a problem in that the resiliency of the clip necessitates its deformation during installation and thereby accurate panel spacing may be denied.

(3) Objects of the Invention

No prior art system utilizes a resiliently engaging stud clip separable from panel engaging clips whereby mounting is attained by lifting and locking the panel clips to a stud clip. While some lifting and locking has occurred by utilization of slotted studs, no conventionally shaped stud, such as a C-shaped channel strut, has been envisioned for use with such so-called lift and lock systems.

It would therefore be desirable to provide a mounting means for wall panels in hollow-wall partition construction affording positive panel spacing by utilizing a lift and lock engagement of panel-engaging clips to a resiliently engaging stud clip. It has also been a goal of the construction industry to provide such a system wherein panel clips are interchangeable at either side of a joint and wherein stud clips are stud engageable at either side of the stud.

It would additionally be a desired solution to previously encountered problems to provide individually accessible panels wherein adjoining panels are not disturbed and accessibility at particular panel locations may be obtained.

It would be an allied solution to provide an accessible partition system wherein the mounting of the panels is made with the panels being positioned parallel with adjacent panels then horizontally moved into the plane of the wall followed by a slight downward movement to hook panel clips over stud clips without requiring rotation of panels which may otherwise create chipping of the edges and misalignment at the joints.

In accordance with this last-cited object it would be highly desirable to provide removability by the reversal of these steps by lifting the panel to disengage, or unlock, panel clips from stud clips and then horizontally displacing the panel outward while maintaining it in a safe parallel relationship with adjoining panels to remove it from the wall surface for access therebehind or relocation elsewhere in the system.

SUMMARY OF THE INVENTION

All the goals, aims, and objects of this invention are attained by providing an accessible partition wall construction comprising in combination: two parallel spaced-apart rows of wall panels, adjoining panels meeting at joints along marginal edges; channel-shaped studs disposed at said joints, said studs having a generally C-shape with parallel arms of the C residing parallel with interior panel faces and connected by an integrally connecting web portion at longitudinal clip-engageable ribs; stud clips engaging said studs at a flange and rib, said stud clips having a flat body portion with a stud flange-engaging struck out tab opposing a resilient end of a struck out rib-engaging resilient tongue, the flange-engaging tab struck out inwardly in a direction opposite a stud flange, said stud flange tested between the tab and body portion, said rib-engaging tongue struck out inwardly at an angle with the body portion and having said resilient end portion engaging a stud rib, said body portion extending sideward beyond said stud at either side thereof to provide panel clip engageable surfaces at opposite sides of the stud; interchangeable panel clips removably engaging the stud clips, said panel clips having a generally cross-sectional J-shape with a short arm connected by a web to a parallel spaced-apart long arm, said short arm engaging a panel marginal edge and said web coacting along a marginal edge of the panel, said long arm disposed along an interior face of a panel terminating in oppositely extending projections spaced-apart from the long arm at a side opposite the interior panel face, one said extending projection removably overlapped over an engageable surface of the body portion of the stud clip, said long arm further having an alignment ear struck out therefrom at a side opposite the interior face of the panel generally centrally between said extending projections providing an alignment means facilitating stud clip engagement; whereby said partition wall construction allows accessibility by lifting a panel upward to slide said overlapping panel clip extending projection off said stud clip engageable surface and then horizontally moving said panel away from the partition wall construction, and reinstallation is accommodated by reversing the procedure, and whereby said panel clips are interchangeable at either side of a joint wherein said extending projections are substantially identical and the panel clip is symmetric about a horizontal plane.

The objects and goals of this invention are further obtained by providing a panel clip and stud clip assembly which comprises a pair of substantially identical panel clips and a stud clip wherein the panel clips are interchangeable, said assembly is adaped for use in wall partition construction utilizing spaced-apart rows of wall panels and channel-shaped studs with engageable flanges and ribbed portions at the juncture of the flanges with an integrally connecting web, said panel clip being symmetric about a horizontal plane and having a cross-sectional J-shape with a short arm adapted for engaging marginal panel edges and integrally connected to a web portion adapted to coact along a marginal edge of a panel, said web integrally connecting the long arm of the J-shape, said long arm terminating in a stud clip engageable means comprising two oppositely extending struck out projections, one extending projection extending downwardly and the other extending upwardly, said projections struck out adjacent upper and lower marginal edges of said long arm, and an alignment tongue struck out from said long arm mediate said oppositely extending projections facilitating alignment with a stud clip, said stud clip comprising a flat body portion with a stud flange-engaging struck out tab opposing a resilient end of a rib-engaging resilient tongue, the struck out tab spaced-apart from said body portion sufficient to accommodate a stud flange nested between the body portion and tab, said rib-engaging resilient tongue struck out at an angle to said body portion, wherein said body portion extends sufficiently sideward of said tongue and tab to provide engageable surfaces for overlapping by the extending projections of said panel clips, whereby said assembly provides panel accessibility by means of an extending projection of the panel clips overlapping an engageable surface of the stud clip body portion and being demountable by lifting upward on an engaged panel to remove the panel clips from the stud clip and thence moving the panel outward away from the wall partition construction whereby said assembly provides reinstallation of a panel by reversing this procedure.

A BRIEF DESCRIPTION OF THE DRAWINGS

Other objects and advantages of the invention will become apparent upon reading the following detailed description, and upon reference to the drawings in which.

DESCRIPTION OF THE PREFERRED EMBODIMENT

Figure 1:
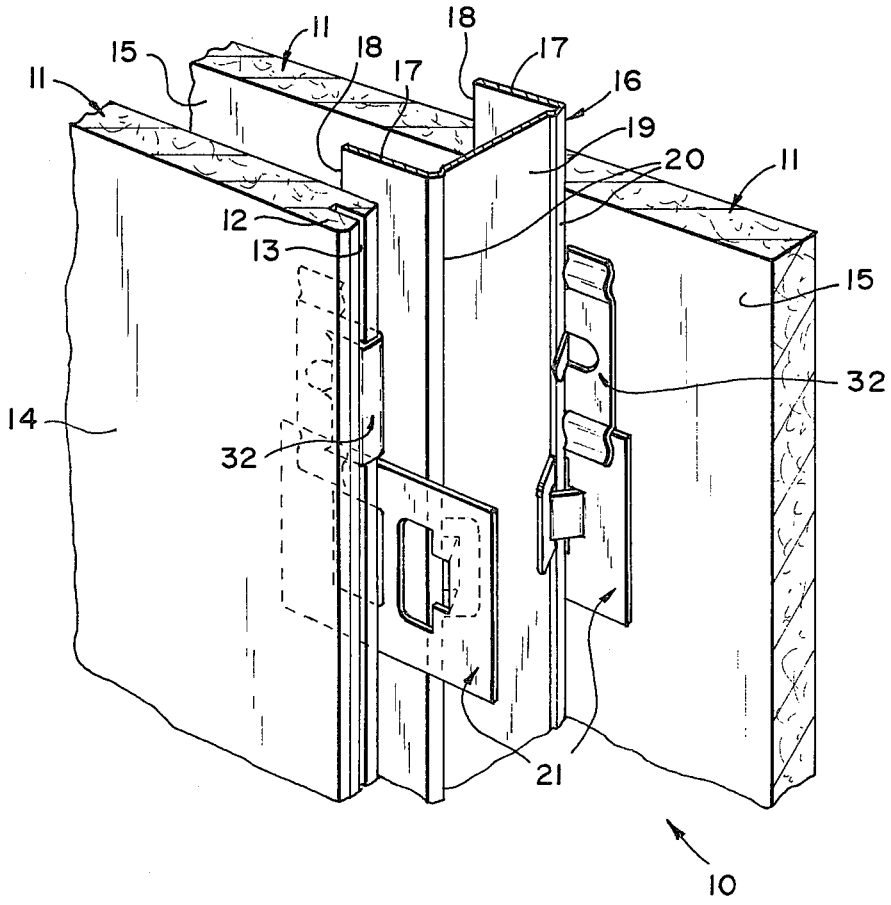
FIG. 1 is a perspective view of a portion of a hollow-wall partition construction with one panel at a joint removed to illustrate the accessible partition wall construction in accordance with this invention.

FIG. 1 shows typical partition wall 10 at a joint location and being partially broken away to illustrate the preferred embodiment for this invention. Partition wall 10 comprises two spaced-apart rows of panels 11 having marginal edges 12 with longitudinal kerfs 13 cut therein. Exterior surfaces 14 of panels 11 provide the exposed areas at the room side. Interior surfaces 15 of panels 11 are shown at the opposite side of panels 11 in the hollow portion of partition wall 10. At the typical joint shown in FIG. 1, studs 16 are provided in a generally C-shaped channel configuration. Flanges 17 reside parallel with interior surfaces 15 and terminate in free ends 18. Flanges 17 are integrally connected by a web 19 and at the connection a longitudinal rib 20 is provided.

FIG. 1 additionally shows stud clips 21 attached to stud 16 at both flanges 17. Attached to panels 11, engaging within kerfs 13, are panel clips 32 in the preferred form for this invention. Erection of partition wall 10 is first accomplished by engaging studs 16 with stud clips 21 at predetermined locations in regular spaced-apart intervals. Before mounting, panels 11 are engaged by pairs of panel clips 32 at either side of the joint at predetermined spaced-apart regular intervals along marginal edges 12. The major characterizing aspect of this invention is its "lift and lock" feature. This feature allows panels 11 to be lifted to pre-positioning with panel clips 32 slightly above stud clips 21. Panels 11 are then lowered to engage panel clips 32 with stud clips 21 for a hooking, or overlapping, locked alignment. This locking prevents horizontal forces from moving panels 11 from position and also positively positions the panels 11 at desired locations with accurate spacings between adjoining panels.

Figure 2:
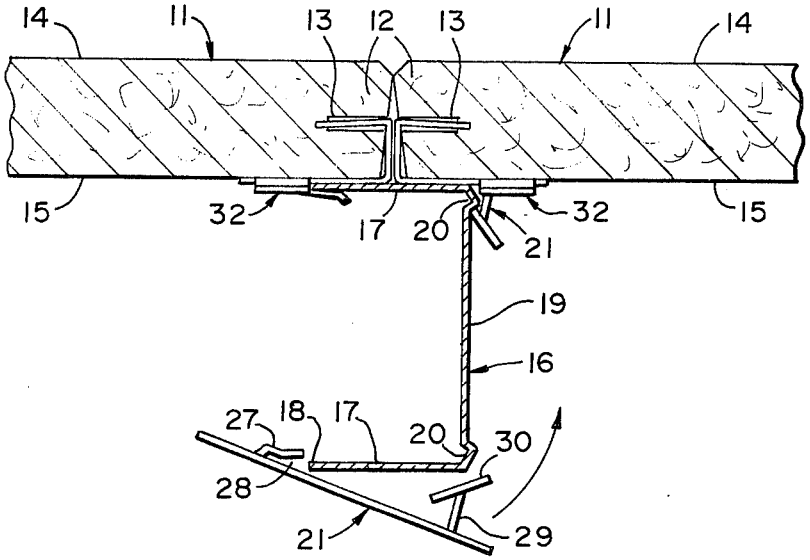
FIG. 2 is a cross-sectional view showing a stud at a joint in a hollow-wall partition assembly having one side fully assembled and at the opposite side having the panels and panel clip of this invention removed to show the resilient engagement of the stud clip.

With reference taken now to FIG. 2, a cross-sectional view of a typical joint of partition wall 10 is illustrated having panels 11 at only one side of stud 16 for illustrative purposes. Panels 11 are shown with panel clips 32 engaging marginal edges 12 along kerfs 13. Stud clip 21 at one side of stud 16 is shown in its fully engaged configuration with panel clips 32 hooking, or overlapping, stud clips 21 for positive locked alignment. A concomitant typifying feature of this invention involves the ability to demount panels 11 from partition wall 10 by reversing the erection procedure and simply lifting panels 11 upward to disengage panel clips 32 from stud clip 21 in a simple upward lifting and outward shifting maneuver. At the other side of stud 16 the resilient, or snap-on, engagement of stud clip 21 is illustrated with stud clip 21 shown in a pre-engaged location prior to nesting engagement with flange 17 and snap-engagement of longitudinal rib 20. Stud clips 21 are engaged by nesting free ends 18 of flanges 17 and by snap-engaging longitudinal rib 20. This engagement allows stud clip 21 to vertically slide along stud 16. This additional sliding feature allows stud clip 21 to be located slightly above its final position whereby when panels 11 are lifted into position and lowered for engagement of panel clip 32, stud clip 21 is allowed to move slightly downward for sure engagement of panel clip 32 and thereby becomes located at its final position. Panel clips 32 are envisioned as being fixed in location along marginal edges 12 and do not slide as do stud clips 21. Therefore, panel clips 32 define the final position of stud clip 21.

Figure 3:
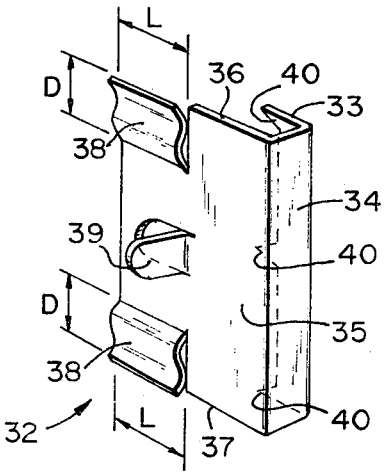
FIG. 3 is a perspective view of the preferred embodiment for the panel clip in accordance with this invention.

Turning now to FIG. 3, panel clip 32 is shown in perspective view illustrating the elements thereof which allow these characterizing mounting and demounting aspects of the invention to be obtained. Preferably, panel clip 32 has a generally J-shape, with short arm 33 integrally connected by web 34 to long arm 35. Panel clip 32 is designed such that short arm 33 may engage kerfs 13 of marginal edges 12 and web 34 is positioned to coact along marginal edges 12. Long arm 35 is adapted to contact interior surfaces 15 of panels 11 extending generally in the same direction as short arm 33 in parallel relationship thereto. In the desirable configuration for short arm 33, impaling prongs 40 are provided in order that panel clip 32 be driven into fixed position along marginal edges 12 of panels 11. Non-kerfed panels, such as simple square edged or rabbet edge panels, are alternately engageable by use of impaling prongs 40 wherein impaling prongs 40 would be simply driven inward until web 34 would abut the marginal panel edge. Short arm 33 alternately may have a simple flat non-prong edge for use with longitudinal kerfs running substantially the full panel edge or spaced-apart single kerfs at pre-determined intervals. With this non-prong edge, short arm 33 would desirably be slightly thicker than the kerfing to thereby allow it to be wedged in a relatively fixed manner within the kerf.

Continuing with FIG. 3, long arm 35 is shown in a generally flat or plate-like configuration having marginal upper edge 36 and marginal lower edge 37. Struck out from long arm 35 are the hook or overlapping engageable elements comprising oppositely extending projections 38 struck out from long arm 35 adjacent marginal upper edge 36 and adjacent marginal lower edge 37 at the end of long arm 35 distal to its integral connection with web 34. Extending projections 38 are struck out a distance D from long arm 35 and are spaced-apart from long arm 35 at a side of long arm 35 which would be opposite an interior surface 15 of a panel 11 upon engagement thereto. Distance D is provided to correspond with later-described distance D' for struck out tab 27 and struck out tongue 29 of stud clip 21 such that, upon said overlapping hook engagement of panel clip 32 with stud clip 21, projections 38 do not extend to contact these stud clip elements thus allowing overlap of distance D upon engagement. Extending projections 38 are substantially identical and extend in opposite vertical directions permitting interchangeability at either side of a panel joint. Length L denotes the generally horizontal width of extending projections 38 which preferably equals length L' for later-described stud clip 21. In providing lengths L and L' in equivalent dimensions, horizontal overlap of this amount is attained. Mediate extending projections 38 is alignment ear 39 struck out from long arm 35 and being struck out in a direction which is inward of panels 11 away from interior surfaces 15 upon engagement thereto. Alignment ears 39 is provided in a position along long arm 35 such that when panels 11 are engaged by panel clips 32 they may be positioned with alignment ear 39 abutting either free ends 18 of flanges 17 or longitudinal rib 20 thus properly positioning an extending projection 38 positively above its final engaging overlapping position with stud clip 21. To ensure alignment, alignment ear 39 is desirably located from web 34 at about one-half the width of flange 17 of stud 16. Accordingly, alignment ear 39 simplifies positive installation of panels 11 in correct alignment with stud 16. Panel clips 32 are preferably symmetric about a horizontal plane taken through the central horizontal axis of long arm 35 passing through centrally located alignment ear 39. In this configuration, panel clip 32 is shown to be reversible for interchangeability at either side of the joint. Therefore, in one alignment, the downwardly pointed extending projection 38 would be the stud clip 21 engageable element whereas if flipped over 180°, and utilized at the other side of a joint, the upwardly pointed extending projection 38 would be pointed downwardly and it would be the overlapping engageable element for stud clip 21 as would be clear to one skilled in the wall construction art.

Figure 4:
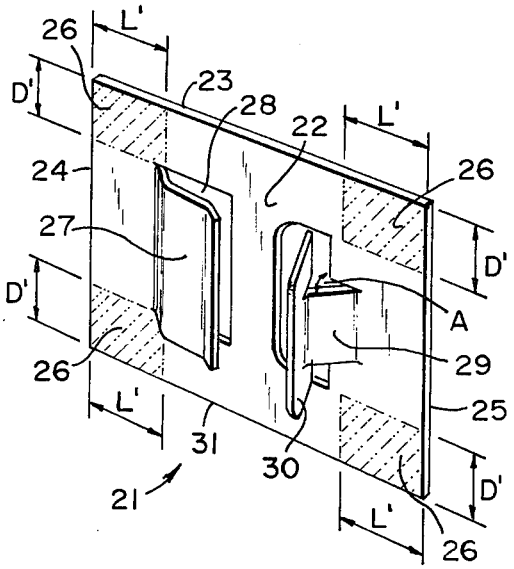
FIG. 4 is a perspective view of the preferred embodiment for the stud clip in accordance with this invention.

FIG. 4 shows stud clip 21 in its preferred embodiment in a perspective view. Stud clip 21 preferably has a flat body 22 having an upper edge 23 and a lower edge 31 accommodating overlap by extending projections 38 of panel clip 32. Opposite marginal side edges 24 and 25 are the opposite edges of flat body 22 and are spaced-apart at sufficient distance to extend about equally beyond free end 18 of flange 17 in one direction and beyond longitudinal rib 20 in the other direction. Engageable overlapping portions 26 are generally shown adjacent upper edge 23 and lower edge 31 and are generally defined as being the portions of flat body 22 each of which may be engageable by an extending projection 38. The vertical boundaries of engageable portions 26 are defined by the extent of distance D' which corresponds to the distance D illustrated in FIG. 3 for panel clips 32. The horizontal boundaries of engageable portions 26 are defined by length L' which corresponds to length L illustrated also in FIG. 3 for panel clips 32. Flat body 22 further comprises a struck out tab 27 which is struck out inwardly from flat body 22 at a distance no less than distance D' from upper edge 23. Struck out tab 27 provides a nesting slot 28 for engagement with flanges 17 about free ends 18 thereof. Spaced-apart from struck out tab 27 is struck out tongue 29 which is struck out from flat body 22 at an angle A therefrom. Angle A is preferably an acute angle, but may be 90° or greater. Struck out tongue 29 terminates in a resilient end portion shown as plate 30 for snap-engagement over longitudinal ribs 20 of studs 16. Plate 30 is disposed to be in a direction generally opposing struck out tab 27. Struck out tongue 29 is preferably struck out at a vertical distance no less than distance D' from upper edge 23. Also, engageable overlapping portion 26 is sidewardly defined by length L', the distance of struck out tab 27 from side edge 24 and the distance of struck out tongue 29 from side edge 25. This sideward dimension, length L', is sufficient such that extending projections 38 of panel clip 32 do not contact struck out tab 27 or struck out tongue 29 during installation procedures facilitating substantially complete overlap. Lengths L and L' are preferably about equal to afford full overlap of extending projections 38, but full overlap is not mandatory and length L' may be less than length L in an alternate embodiment. As is apparent, length L' may also be greater than length L, which would also provide said full overlap. Accordingly, when length L' exceeds length L, distance D may be greater than distance D' since extending projections 38 could then be provided a sufficient dimension away from struck out tab 27 and struck out tongue 29 to not harmfully contact during overlapped engagement. Such alteration of the configuration for stud slip 21 and panel clip 32 is considered as being well within the spirit and broad scope of the instant invention as would be clear to one skilled in the art.

Stud clip 21 is usable in an interchangeable manner at either side of a stud 16 and may be flipped over 180° for engagement at either side. Distance D' is provided from both upper edge 23 and lower edge 31. Length L' is also provided from both side edge 24 and side edge 25. Thus, engageable surfaces 26 would be equally suited for hooking, or overlapping, engagement by extending projections 38 when stud clip 21 is located at either side of a stud 16.

It is thus apparent that, as illustrated in FIGS. 3 and 4, stud clips 21 and panel clips 32 have versatile utility for partition wall 10. Stud clips 21 are usable at either side of a stud 16 and are engageable with flanges 17 and longitudinal ribs 20 at either side of stud 16 by being rotated, or flipped over, 180° as described. Additionally, panel clips 32 are interchangeable at either side of a joint and as clear in FIG. 3, the upwardly pointed extending projection 38 would accordingly be pointed downwardly for an overlapping engagement in a substantially identical relationship as shown with reference to the downwardly pointed extending projection 38. Both stud clip 21 and panel clips 32 are preferably comprised of light-gauge steel. Stud clip 21 is provided in a range of gauges of from about 16 gauge to 28 guage. Panel clips 32 are provided preferably in a range of gauges of from 22 gauge to about 28 gauge with an overall vertical dimension of from about one inch to about three inches. Utilization of the assembly of stud clip 21 and panel slips 32 are attained with conventional studing members such as stud 16 having a well known and widely used channel-shaped configuration with a longitudinal rib 20 being generally provided as a reinforcing element at the juncture of flanges 17 with web 19. Additionally, panels 11 are envisioned as being widely utilized one-half inch to one inch thick gypsum wallboard panels having a typical kerfed edge configuration. However, non-kerfed panel edges are also adaptable for use with the instant invention as previously described. Thus it is seen that partition wall 10 comprises well known panels and stud elements without the need for specially designed configurations.

In the embodiment disclosed for the preferred form of the invention, distances D and D′ are approximately three-eighths of an inch, thereby disengagement of panel clips from stud clips is attainable by a simple vertical displacement of this distance. Lengths L and L′ are preferably about three-eighths of an inch also. Distances D and D′, and lengths L and L′, may vary within an envisioned range of from about one-quarter of an inch to about two inches. Panel clips 32 could be replaced by a continuous panel edge-engaging channel fabricated to have hooks in both upward and downward directions, similar to extending projections 38, and located at specified intervals. The inventive aspects disclosed herein thereby avoid the snap-engagement of panel clips with studs, or stud clips, and utilize a simple overlapping hook engagement characterized by a "lift and lock" mounting maneuver. Individual panels 11 are thereby singly demountable without impairing alignment of adjoining panels for access to the hollow area between rows of panels 11. A removed panel can easily be reinstalled by this "lift and lock" maneuver again without impairing adjoining panels or spacing at joints. An assembly of a pair of panel clips 32, and a corresponding stud clip 21, is preferably provided along panel joints at regular spaced-apart intervals of from about twelve to twenty-four inches center-to-center for proper panel retention and ease of installation.

Thus it is seen that there has been provided a fully accessible partition wall construction solving all the problems of the prior art characterized by positively engaging elements for simplified installation and demounting procedures highly desirable in the construction industry.

While the invention has been described in conjunction with specific embodiments thereof, it is evident that many alternatives, modifications, and variations will be readily apparent to those skilled in the art in light of the foregoing description. Accordingly, it is intended to embrace all such alternatives, modifications, and variations as fall within the spirit and broad scope of the appended claims.

I claim:

1. An accessible partition wall construction comprising in combination:

two parallel spaced-apart rows of wall panels, adjoining panels meeting at joints along marginal edges;

channel-shaped studs disposed at said joints, said studs having a generally C-shape with parallel arms of the C residing parallel with interior panel faces and connected by an integrally connecting web portion at longitudinal engageable ribs;

stud clips engaging said studs at a flange and rib, said stud clip having a flat body portion with a stud flange-engaging struck out tab opposing a resilient end of a struck out rib-engaging resilient tongue, the flange-engaging tab struck out inwardly in a direction opposite a stud flange, said stud flange nested between the tab and body portion, said rib-engaging tongue struck out inwardly at an angle with the body portion and having said resilient end portion engaging a stud rib, said body portion extending sideward beyond said stud at either side thereof to provide panel clip engageable surfaces at opposite sides of the stud;

interchangeable panel clips removably engaging the stud clips, said panel clips having a generally cross-sectional J-shape with a short arm connected by a web to a parallel spaced-apart long arm, said short arm engaging a panel marginal edge and said web coacting along the marginal edge of the panel, said long arm disposed along an interior face of a panel terminating in oppositely extending projections spaced apart from the long arm at a side opposite the interior panel face, one said extending projection removably overlapped over an engageable surface of the body portion of the stud clip, said long arm further having an alignment ear struck out therefrom at a side opposite the interior face of the panel generally centrally between said extending projections providing an alignment means facilitating stud clip engagement, whereby said partition wall construction allows accessibility by lifting a panel upward to slide said overlapped panel clip extending projection off said stud clip engageable surface and then horizontally moving said panel away from the construction, and reinstallation is accommodated by reversing the procedure, whereby said panel clips are interchangeable at either side of a joint wherein said extending projections are substantially identical and the panel clip is symmetric about a horizontal plane.

2. The combination as in claim 1 wherein the panel clips are provided in pairs along a joint at spaced-apart vertical intervals and a stud clip positioned for engagement with each pair of clips.

3. The combination as in claim 1 wherein the short arm of the J-shaped panel clip has a plurality of impaling prongs extending therefrom whereby said panel clips are engaged to a panel marginal edge and maintained in place facilitating placing a panel into engagement with a stud clip.

4. The combination as in claim 1 wherein the panel clips comprise light-guage steel of from about 22 to 28 gauge and have a vertical overall dimension from about one inch to about three inches.

5. The combination as in claim 1 wherein the stud clip comprises light-gauge steel of from about 16 to 28 gauge.

6. The combination as in claim 1 wherein the engageable surfaces of the stud clip body portion extend sideward a distance from the stud a distance no less than the width of the extending projection of the panel clip facilitating overlapping engagement by said extending projection across substantially its entire width.

7. The combination as in claim 1 wherein the wall panels have a thickness of from about one-half inch to about one inch.

8. The combination as in claim 7 wherein the wall panels have longitudinal kerfs located medially along marginal side edges.

9. The combination as in claim 1 wherein the alignment ear is located on said panel clip long arm at a distance from said web of about one-half the width of an engaged stud flange whereby installation is facilitated by aligning the panel clip in proper position for overlapping engagement of said extending projections at said engageable surfaces of said stud clip.

10. The combination as in claim 1 wherein the extending projections of the panel clip are struck out a distance short of contacting the tongue and tab of said stud clip to thereby permit said overlap engagement to the engageable surfaces of the body portion adjacent and above said tongue and tab.

11. A panel clip and stud clip assembly comprising a pair of substantially identical panel clips and a stud clip wherein the panel clips are interchangeable, said assembly adapted for use in wall partition construction utilizing spaced-apart rows of wall panels and channel shaped studs with engageable flanges and ribbed portions at the juncture of the flanges with an integrally connecting web, said panel clip being symmetric about a horizontal plane and having a cross-sectional J-shape with a short arm adapted for engaging marginal panel edges and integrally connected to a web portion adapted to coact along a marginal edge of a peanel, said web integrally connecting the long arm of the J-shape, said long arm terminating in a stud clip engageable means comprising two oppositely extending struck out projections, one struck out projection extending downwardly and the other extending upwardly, said projections struck out adjacent upper and lower marginal edges of said long arm, and an alignment tongue struck out from said long arm mediate said oppositely extending projections facilitating alignment with a stud clip, said stud clip comprising a flat body portion with a stud flange-engaging struck out tab opposing a resilient end of a rib-engaging resilient tongue, the struck out tab spaced apart from said body portion sufficient to accommodate a stud flange nested between the body portion and tab, said rib-engaging resilient tongue struck out at an angle to said body portion, wherein said body portion extends sufficiently sideward of said tongue and tab to provide engageable surfaces for overlapping by the extending projections of said panel clips, whereby said assembly provides panel accessibility by means of an extending projection of the panel clips overlapping an engageable surface of the stud clip body portion and being demountable by lifting upward on an engaged panel to remove the panel clips from the stud clip and thence moving the panel outward away from a wall partition construction whereby said assembly provides reinstallation of a panel by reversing this procedure.

12. An assembly as in claim 11 wherein the short arm of the J-shaped panel clips have impaling prongs extending therefrom facilitating impalement of a panel marginal edge to thereby maintain said panel clips in position along the marginal edge of a panel facilitating installation.

13. An assembly as in claim 11 wherein the panel clips comprise light-gauge steel of from about 22 to about 28 gauge and the stud clip comprises light-gauge steel of from about 16 to 28 gauge.

14. An assembly as in claim 11 wherein the engageable surfaces of the body portion of the stud clip extend sidewardly of said tongue and tab a distance no less than the width of the extending projections of the panel clips facilitating overlapped engagement by an extending projection across substantially its entire width.

15. An assembly as in claim 11 wherein said assembly is provided at joints between adjoining panels at vertical intervals of from about twelve inches to twenty-four inches.

16. An assembly as in claim 11 wherein said panel clips are adapted to extend into longitudinal kerfs along marginal edges of a wall panel in a relatively fixed manner and wherein said stud clips are resiliently engageable to channel-shaped studs and are adapted to slide along said stud whereby installation of panels is facilitated by said stud clips lifted into alignment and moved downward to positively overlap said extending projections onto said stud clips moving said stud clips into final position.

17. An assembly as in claim 11 wherein the extending projections of the panel clips are struck out a distance short of contacting the tongue and tab of said stud clip to thereby permit said overlap engagement to the engageable surfaces of the body portion adjacent and above said tongue and tab.

* * * * *